US008919372B2

(12) United States Patent
Fischetti et al.

(10) Patent No.: US 8,919,372 B2
(45) Date of Patent: Dec. 30, 2014

(54) VALVE ASSEMBLY FOR AN INJECTION VALVE AND INJECTION VALVE

(75) Inventors: Gianbattista Fischetti, Cascina (IT); Luigi Gargiulo, Pisa (IT); Marco Mechi, Vada (IT); Ileana Romeo, Grossetto (IT)

(73) Assignee: Continental Automotive GmbH, Hannover (DE)

( * ) Notice: Subject to any disclaimer, the term of this patent is extended or adjusted under 35 U.S.C. 154(b) by 583 days.

(21) Appl. No.: 13/265,190

(22) PCT Filed: Apr. 14, 2010

(86) PCT No.: PCT/EP2010/054908

§ 371 (c)(1), (2), (4) Date: Oct. 19, 2011

(87) PCT Pub. No.: WO2010/121934

PCT Pub. Date: Oct. 28, 2010

(65) Prior Publication Data

US 2012/0037719 A1 Feb. 16, 2012

(30) Foreign Application Priority Data

Apr. 20, 2009 (EP) ..... 09005549

(51) Int. Cl.

| | |
|---|---|
| ***F02M 61/06*** | (2006.01) |
| ***F02M 61/08*** | (2006.01) |
| ***F02M 51/06*** | (2006.01) |
| ***F02M 61/20*** | (2006.01) |

(52) U.S. Cl.

CPC ..... *F02M 51/0657* (2013.01); *F02M 51/0682* (2013.01); *F02M 61/205* (2013.01)

USPC ..... 137/514.7; 137/601.2; 137/601.21; 251/51; 251/55; 239/585.5

(58) Field of Classification Search

CPC ..... F02M 61/18; F02M 61/205; F02M 60/08

USPC ..... 137/601.2, 514.7, 514.5, 601.21; 251/50, 55, 51, 52; 239/585.5

See application file for complete search history.

(56) References Cited

U.S. PATENT DOCUMENTS 72,809 A * 12/1867 Craigie ..... 251/51
7,431,226 B2 * 10/2008 Cho et al. ..... 239/585.1

(Continued)

FOREIGN PATENT DOCUMENTS

DE 102004038189 A1 3/2006 ..... F02M 45/00
DE 102005052254 A1 5/2007 ..... F02M 51/00

(Continued)

OTHER PUBLICATIONS

International PCT Search Report and Written Opinion, PCT/EP2010/054908, 12 pages.

*Primary Examiner* — Atif Chaudry
(74) *Attorney, Agent, or Firm* — King & Spalding L.L.P.

(57) ABSTRACT

A valve assembly for an injection valve has a valve body with a central longitudinal axis and a cavity with a fluid inlet portion and a fluid outlet portion, a valve needle axially movable in the cavity, the needle preventing a fluid flow in a closing position and releasing the fluid flow via a main fluid line in further positions, a member being fixedly associated to the needle and having a surface facing the outlet portion, a first chamber embodied in the cavity, a second chamber being part of the main line, and a one-way-valve which is hydraulically arranged between the first and second chamber to prevent a fluid flow through a first fluid path in a closing position of the one-way-valve and to release a fluid flow through the first fluid path between the first and second chamber in further positions of the one-way-valve.

18 Claims, 2 Drawing Sheets

(56) References Cited

U.S. PATENT DOCUMENTS

| | | | | |
|---|---|---|---|---|
| 7,819,344 | B2 | 10/2010 | Abe et al. | 239/585.2 |
| 2002/0079388 | A1 | 6/2002 | Tian et al. | 239/585.1 |
| 2004/0011899 | A1 | 1/2004 | Dantes et al. | 239/585.1 |
| 2007/0075166 | A1 | 4/2007 | Tsuchiya et al. | 239/585.1 |

FOREIGN PATENT DOCUMENTS

| | | | | |
|---|---|---|---|---|
| EP | 1820958 | | 1/2007 | F02M 51/06 |
| EP | 1990532 | A1 | 11/2008 | F02M 47/02 |

* cited by examiner

FIG 3 III

VALVE ASSEMBLY FOR AN INJECTION VALVE AND INJECTION VALVE

CROSS-REFERENCE TO RELATED APPLICATIONS

This application is a U.S. National Stage Application of International Application No. PCT/EP2010/054908 filed Apr. 14, 2010, which designates the United States of America, and claims priority to EP Application No. 09005549.2 filed Apr. 20, 2009, the contents of which are hereby incorporated by reference in their entirety.

TECHNICAL FIELD

The invention relates to a valve assembly for an injection valve and an injection valve for a combustion chamber of a combustion engine.

BACKGROUND

Injection valves are in widespread use, in particular for internal combustion engines where they may be arranged in order to dose fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter, and also various elements of the injection valve being responsible for the way the fluid is dosed may vary in a wide range. In addition to that, injection valves may accommodate an actuator for actuating a needle of the injection valve, which may, for example, be an electromagnetic actuator or a piezoelectric actuator.

In order to enhance the combustion process in view of the creation of unwanted emissions, the respective injection valve may be suited to dose fluids under very high pressures. The pressures may be in the case of a gasoline engine in the range of up to 200 bar and in the case of a diesel engine in the range of up to 2 000 bar, for example.

EP 1 820 958 A2 discloses an injector used for an internal combustion engine includes a valve needle which closes a fuel passage by being contacted on a valve seat and opens the fuel passage by separating from the valve seat, a coil and a magnetic core which are provided as a drive means of the valve needle, an anchor held in a relatively displaceable state with respect to the valve needle, a first biasing means biasing the valve needle in a direction opposite to a direction of a drive force, a second biasing means biasing the anchor in the direction of the drive force with a set load smaller than that of the first biasing means, and a restricting means restricting relative displacement of the anchor with respect to the valve needle in the direction of the drive force.

SUMMARY

According to various embodiment, a valve assembly can be created which may be manufactured in a simple way and which facilitates a reliable and precise function.

According to an embodiment, a valve assembly for an injection valve, may comprise:—a valve body comprising a central longitudinal axis and a cavity with a fluid inlet portion and a fluid outlet portion,—a valve needle axially movable in the cavity, the valve needle preventing a fluid flow through the fluid outlet portion in a closing position and releasing the fluid flow via a main fluid line from the fluid inlet portion to the fluid outlet portion in further positions,—a member being fixedly associated to the valve needle and having a surface facing the fluid outlet portion,—a first chamber embodied in the cavity with the surface abutting the first chamber,—a second chamber being part of the main fluid line, and—a one-way-valve being hydraulically arranged between the first chamber and the second chamber and being designed to prevent a fluid flow through a first fluid path between the first chamber and the second chamber in a closing position of the one-way-valve and to release a fluid flow through the first fluid path between the first chamber and the second chamber in further positions of the one-way-valve.

According to a further embodiment, a throttle can be arranged between the first chamber and the second chamber, and is designed to release a fluid flow through a second fluid path between the first chamber and the second chamber. According to a further embodiment, the one-way-valve can be arranged inside the chamber to form a part of a boundary of the first chamber. According to a further embodiment, the one-way-valve may comprise a spring and a closing body, the spring being designed to provide a force acting to bring the closing body in contact with the inner surface of the valve body, and the closing body being shaped as a disk. According to a further embodiment, the spring can be arranged axially between the surface of the valve needle and the closing body to provide a force acting to bring the closing body into contact with the inner surface of the valve body. According to a further embodiment, the inner surface of the valve body or an outer surface of the closing body may comprise a sealing edge, the sealing edge can be designed to prevent the fluid flow through the first fluid path between the first chamber and the second chamber in the closing position of the one-way-valve. According to a further embodiment, the closing body may comprise an opening and the valve needle extending through the opening. According to a further embodiment, the opening may comprise the throttle, and the throttle being designed as a gap between the valve needle and the closing body. According to a further embodiment, the valve needle may be at least partially a hollow needle with an inner recess, the inner recess receiving the main fluid line.

According to another embodiment, an injection valve for a combustion chamber of a combustion engine may comprise a valve assembly as described above.

BRIEF DESCRIPTION OF THE DRAWINGS

Exemplary embodiments are explained in the following with the aid of schematic drawings. These are as follows.

Elements of the same design and function that appear in different illustrations are identified with a same reference characters.

DETAILED DESCRIPTION

Figure 1:
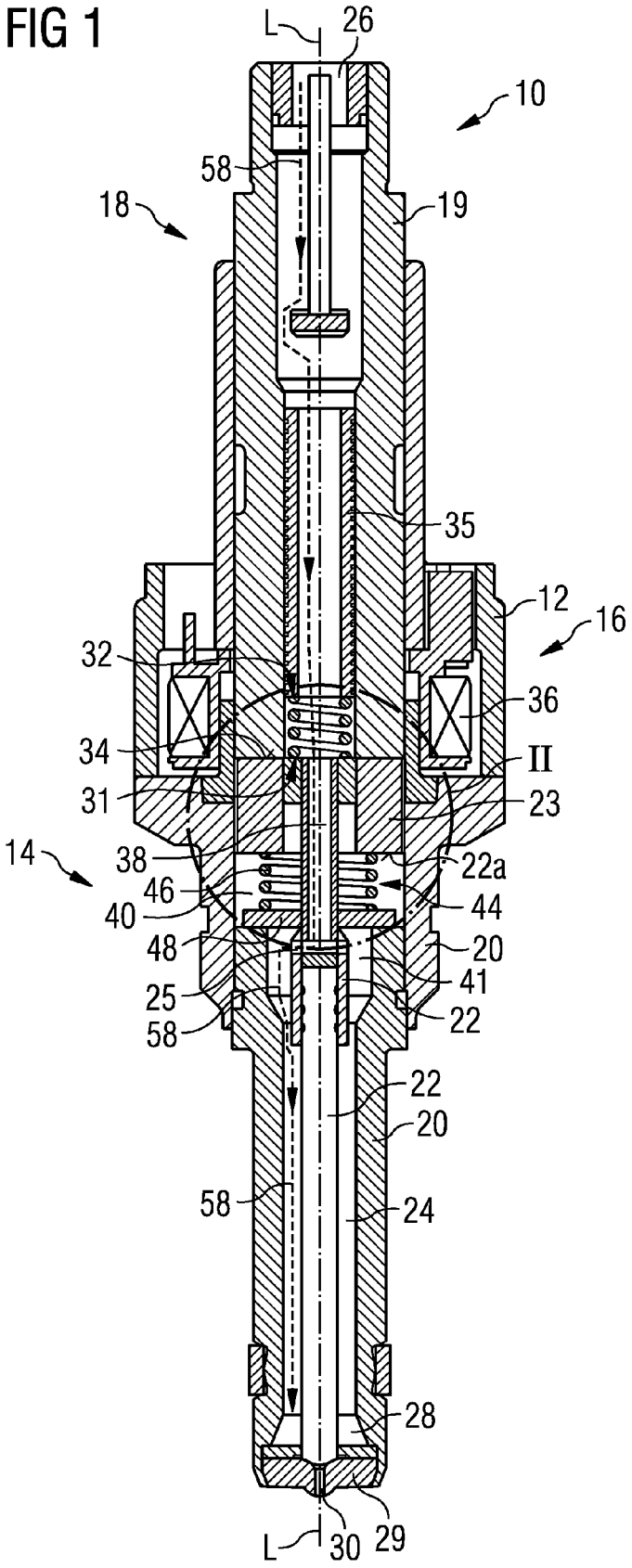
FIG. 1 an injection valve with a valve assembly in a longitudinal section view, FIG. 2 a part II of FIG. 1 with one embodiment of the valve assembly of the injection valve in a longitudinal section view, and FIG. 3 a part III of FIG. 2 with the embodiment of the valve assembly of the injection valve in a longitudinal section view.

According to various embodiments, a valve assembly for an injection valve, may comprise a valve body comprising a central longitudinal axis and a cavity with a fluid inlet portion and a fluid outlet portion, a valve needle axially movable in the cavity, the valve needle preventing a fluid flow through the fluid outlet portion in a closing position and releasing the fluid flow via a main fluid line from the fluid inlet portion to the fluid outlet portion in further positions, a member being fixedly associated to the valve needle and having a surface facing the fluid outlet portion, a first chamber embodied in the cavity with the surface abutting the first chamber, a second chamber being part of the main fluid line, and a one-way-valve. The one-way-valve is hydraulically arranged between the first chamber and the second chamber and is designed to prevent a fluid flow through a first fluid path between the first chamber and the second chamber in a closing position of the one-way-valve and to release a fluid flow through the first fluid path between the first chamber and the second chamber in further positions of the one-way-valve.

The first chamber is hydraulically coupled with the main fluid line via the first fluid path. Therefore a fluid flow between the first chamber and the main fluid line can occur via the first fluid path.

One advantage of this valve assembly is that the first chamber in combination with the one-way-valve can act as a dampening element during the movement of the valve needle. In the case of an upward movement of the valve needle the volume of the first chamber is increasing and the one-way-valve can open. Consequently, fluid flows from the second chamber to the first chamber through the first fluid path. In this case the hydraulic resistance between the first chamber and the second chamber can be small and therefore, the velocity of the valve needle can be high during its upward movement. In the case of a downward movement of the valve needle the volume of the first chamber is decreasing and the one-way-valve can start to close. By this the fluid flow between the first chamber and the second chamber can be retarded and consequently the velocity of the movement of the valve needle can be reduced. Due to that the movement of the valve needle can be dampened because it is coupled with a time consuming fluid flow from the first chamber to the second chamber. Consequently, the first chamber with the fluid contained in the first chamber in combination with the one-way-valve acts as a hydraulic dampening element.

A further advantage of the valve assembly is that during the movement of the valve needle into the closing position an anti-bounce effect occurs. This is due to the fact that the movement of the valve needle can be dampened and therefore an optimal closing velocity of the valve needle can be obtained by dimensioning the mechanical properties of the one-way-valve.

In an embodiment a throttle is arranged between the first chamber and the second chamber, and is designed to release a fluid flow through a second fluid path between the first chamber and the second chamber. This has the advantage that in the case of a downward movement of the valve needle and the decreasing of the volume of the first chamber the fluid flows from the first chamber to the second chamber through the second fluid path and consequently, the velocity of the movement of the valve needle can be selected in a desired manner. This results in a good damping effect of the valve needle during the opening and the closing of the valve needle.

In a further embodiment the one-way-valve is arranged inside the chamber to form a part of a boundary of the first chamber. This allows a simple construction of the one-way-valve.

In a further embodiment the one-way-valve comprises a spring and a closing body. The spring is designed to provide a force acting to bring the closing body in contact with the inner surface of the valve body, and the closing body is shaped as a disk. This has the advantage that the mechanical properties of the spring and the closing body can be selected to allow a good contact between the closing body and the valve body. The process of the lifting of the closing body from the valve body can be carried out in a secure manner due to the disk shape of the closing body.

In a further embodiment the spring is arranged axially between the surface of the valve needle and the closing body to provide a force acting to bring the closing body into contact with the inner surface of the valve body. This has the advantage that a simple construction of the one-way-valve without further devices for the support of the spring is possible.

In a further embodiment the inner surface of the valve body or an outer surface of the closing body comprises a sealing edge. The sealing edge is designed to prevent the fluid flow through the first fluid path between the first chamber and the second chamber in the closing position of the one-way-valve.

By the sealing edge a secure prevention of the fluid flow through the first fluid path between the first chamber and the second chamber is possible. Therefore, in the case of the movement of the valve needle an optimal closing velocity of the valve needle can be obtained.

In a further embodiment the closing body comprises an opening and the valve needle extends through the opening. By this a simple axial symmetric construction of the one-way-valve in the valve assembly is possible.

In a further embodiment the opening comprises the throttle, and the throttle is designed as a gap between the valve needle and the closing body. This has the advantage that a simple construction of the one-way-valve and the throttle is possible.

In a further embodiment the valve needle is at least partially a hollow needle with an inner recess. The inner recess receives the main fluid line.

According to further embodiments, an injection valve for a combustion chamber of a combustion engine may comprise the valve assembly according the first aspect.

An injection valve 10 (FIG. 1) may be used as a fuel injection valve for a combustion chamber of an internal combustion engine and comprises a valve assembly 14, an actuator unit 16 and a fuel connector 18. The fuel connector 18 is designed to be connected to a high-pressure fuel chamber of the internal combustion engine, the fuel is stored under high pressure, for example, under the pressure of about 200 bar in the case of a gasoline engine or of more than 2000 bar in the case of a diesel engine.

The fuel connector 18 has an inlet tube 19 and is fixed to a housing 12 of the actuator unit 16 on one of its free ends. On its upper end the fuel connector 18 comprises a fluid inlet portion 26.

The valve assembly 14 comprises a valve body 20 with a central longitudinal axis L. The valve body 20 has cavity 24 which is axially led through the valve body 20 and which forms an inner surface 21 of the valve body 20.

The valve assembly 14 further comprises a valve needle 22 taken in the cavity 24 of the valve body 20. The valve needle 22 comprises a member 23 being an armature. Alternatively the valve needle 22 may be made in one piece with the member 23 or the valve needle 22 may comprise further parts. The member 23 is fixedly coupled to the valve needle 22. Furthermore, the valve needle 22 is hollow and has a recess 38 which is arranged in direction of the central longitudinal axis L over a portion of the axial length of the valve needle 22.

The valve needle 22 has channels 25 which couple the recess 38 of the valve needle 22 and the cavity 24 of the valve body 20 hydraulically. The recess 38 of the valve needle 22, the channels 25 and the cavity 24 of the valve body 20 are parts of a main fluid line 58 which allows a fluid flow from the fluid inlet portion 26 to a fluid outlet portion 28.

The valve needle 22 comprises a surface 23*a* facing the fluid outlet portion 28. One component of the normal of the surface 23*a* is extending in parallel to the central longitudinal axis L. The surface 23*a* is preferably located on the member 23 and abuts together with the valve body 20 a first chamber 40. The first chamber 40 is embodied in the cavity 24. Furthermore, a second chamber 41 is embodied in the cavity 24 and is part of the main fluid line 58.

On one of the free ends of the cavity 24 of the valve body 20 the fluid outlet portion 28 is formed which is closed or opened depending on the axial position of the valve needle 22. In a closing position of the valve needle 22 it rests sealingly on a seat 29 thereby preventing a fluid flow through at least one injection nozzle 30 in the valve body 20. The injection nozzle 30 may be for example an injection hole, but it may also be of some other type suitable for dosing fluid. The seat 29 may be made in one part with the valve body 20 or may also be a separate part from the valve body 20.

A main spring 31 is arranged inside the inlet tube 19 preferably to rest on a first spring rest 32 and a second spring rest 34. An adjusting tube 35 is provided inside the inlet tube 19. The adjusting tube 35 comprises the first spring rest 32 for the main spring 31 and may be moved axially during the manufacturing process of the injector in order to preload the main spring 31 in a desired way. The second spring rest 34 is arranged on the member 23. By this the main spring 31 is mechanically coupled to the valve needle 22.

The injector is provided with a drive, which is preferably an electromagnetic drive, comprising a coil 36, which is preferably extrusion-coated, the valve body 20, the member 23 and the inlet tube 19 all forming an electromagnetic circuit. The member 23 preferably has a large diameter compared to the diameter of the valve needle 22. The large diameter enables a proper electromagnetic flow through the member 23 which contributes to a proper controllability of the valve needle 22.

If the coil 36 is energized, this results in an electromagnetic force acting on the valve needle 22. The electromagnetic force acts against the mechanical force obtained from the main spring 31. By appropriately energizing the coil 36, the valve needle 22 may in that way be moved away from its closing position which results in a fluid flow through the injection nozzle 30. After a predetermined time the coil 36 may be de-energized again.

Figure 2:
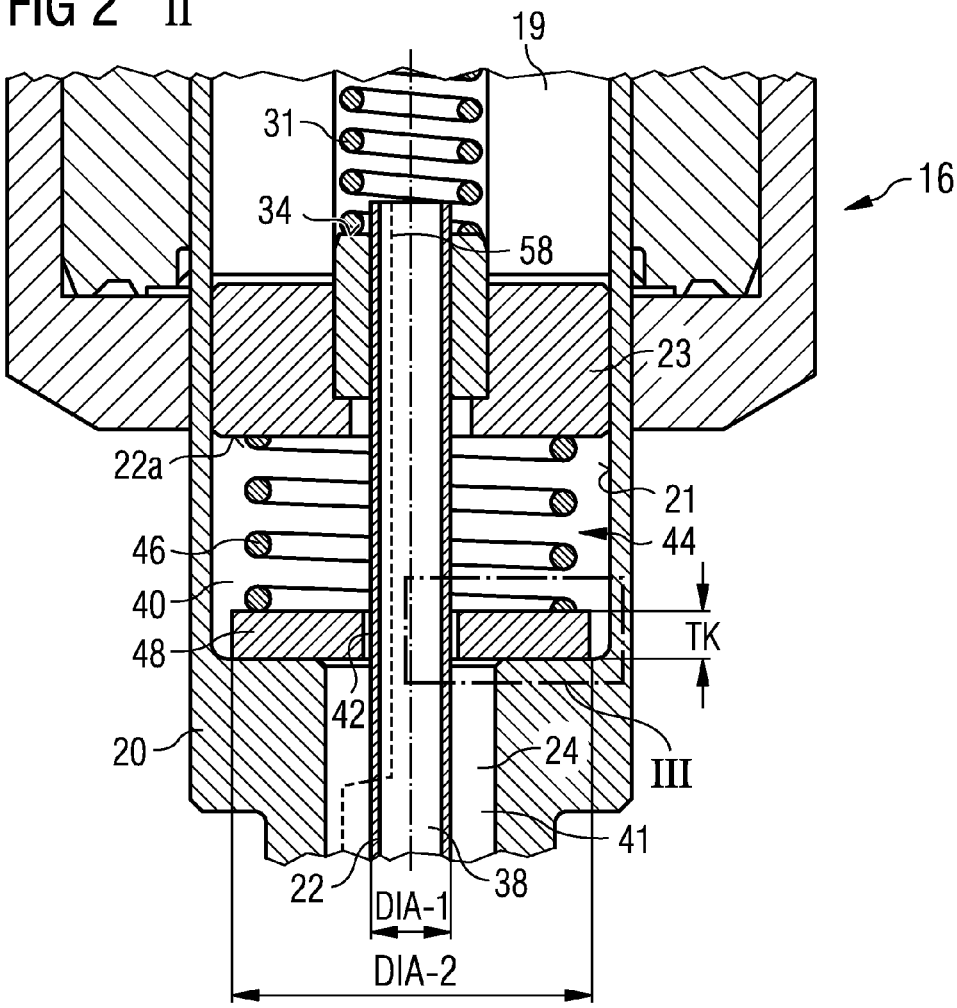
Figure 2:
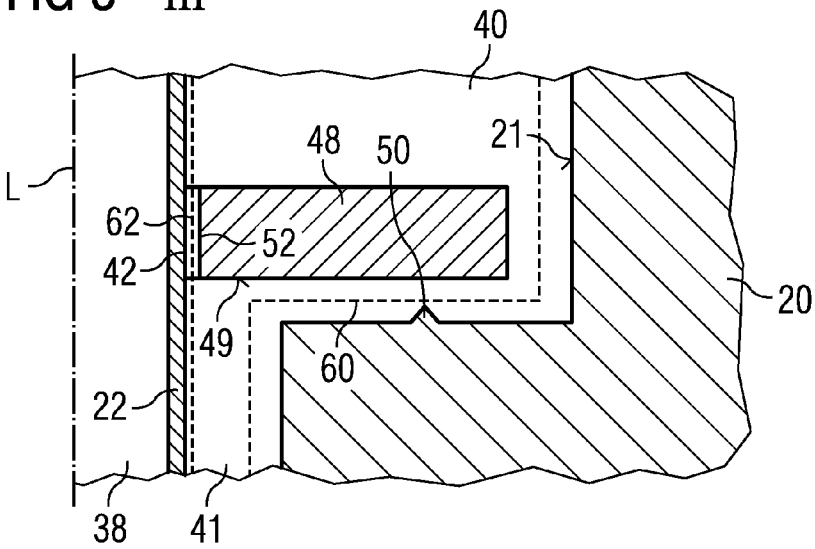

FIGS. 2 and 3 show a section of the valve assembly 14 in an enlarged detailed view. Between the valve body 20 and the valve needle 22 the first chamber 40 is arranged which is coupled hydraulically with the second chamber 41 by a throttle 42 with a diameter DIA_1. Preferably the chamber 40 is arranged axially symmetric relative to the central longitudinal axis L.

Hydraulically between the first chamber 40 and the second chamber 41 a one-way-valve 44 is arranged. Preferably, the one-way-valve 44 is arranged inside the chamber 40 and forms parts of a boundary of the first chamber 40. The one-way-valve 44 has a spring 46 and a closing body 48. The closing body 48 has the shape of a disk with a diameter DIA_2 and a thickness Tk. The spring 46 is arranged in axial direction between the surface 23*a* of the member 23 and the closing body 48 and biases the closing body 48 with a spring rate and a preload force to be in contact with the inner surface 21 of the valve body 20.

The inner surface 21 of the valve body 20 comprises a sealing edge 50. In further embodiments, the sealing edge 50 is arranged on an outer surface 49 of the closing body 48. In the closing position of the one-way-valve 44 the sealing edge 50 can prevent the fluid flow between the first chamber 40 and the second chamber 41 on a way between the closing body 48 and the valve body 20.

The closing body 48 has a central opening 52 and the valve needle 22 extends through the opening 52 in axial direction. The opening 52 comprises the throttle 42. The throttle 42 is forming a gap between the valve needle 22 and the closing body 48 and enables the fluid flow between the first chamber 40 and the second chamber 41.

FIG. 3 shows the valve needle 22 in a position when it is moved away from its closing position. This can result in a position of the closing body 48 distanced from the sealing edge 50 and enabling a fluid flow between the first chamber 40 and the second chamber 41 on a first fluid path 60 and a second fluid path 62. The first fluid path 60 is arranged between the closing body 48 and the valve body 20. The second fluid path 62 is arranged between the closing body 48 and the valve needle 22.

In the following the function of the injection valve 10 is described in detail:

The fluid may flow from the fluid inlet portion 26 of the fuel connector 18 through the inlet tube 19 and the adjusting tube 35 to the recess 38 of the valve needle 22. Through the channels 25 in the valve needle 22 the fluid may flow to the cavity 24 of the valve body 20 and the fluid outlet portion 28. If the valve needle 22 allows a fluid flow through the fluid outlet portion 28 in an opening position the fluid may flow through the injection nozzle 30.

If the valve needle 22 is moving upward from its closing to an opening position fluid may flow from the recess 38 of the valve needle 22 through the throttle 42 to the first chamber 40. The pressure in the first chamber 40 decreases. If the hydraulic force of the second chamber 41 acting on the closing body 48 is higher than the preload force of the spring 46 the closing body 48 comes out of engagement with the sealing edge 50 and fluid can flow from the second chamber 41 to the first chamber 40 via the first fluid path 60. Thus the one-way-valve 44 in combination with the throttle 42 may result in a low velocity of the valve needle 22. This affects the movement of the whole valve needle 22. Therefore, it is possible to adjust the movement of the valve needle 22 by adjusting the spring rate and the preload force of the spring 46 as well as the diameter DIA_2 and the thickness Tk of the closing body 48. By this a damping effect can be achieved which affects the movement of the valve needle 22. This contributes to a precise dosing of the fluid.

If the valve needle 22 is moving downward from an opening position to the closing position the volume of the first chamber 40 has to be reduced and the pressure in the first chamber 40 increases. If the hydraulic force of the second chamber 41 acting on the closing body 48 is lower than the preload force of the spring 46 the closing body 48 comes into engagement with the sealing edge 50. Fluid can flow from the second chamber 41 to the first chamber 40 through the throttle 42 via the second fluid path 62 only. The closing movement of the valve needle 22 is influenced dependent on the quantity of the fluid flow from the first chamber 40 through the throttle 42 to the second chamber 41. The movement of the valve needle 22 may be adjusted by adjusting the diameter DIA_1 of the throttle 42 and the volume of the first chamber 40. This may create a damping effect which influences the movement of the valve needle 22 and therefore contributes to a precise dosing of the fluid.

As the opening and closing movement of the valve needle 22 is affected by the first chamber 40 and the throttle 42 according to their geometry, oscillations of the valve needle 22 may be reduced and therefore an anti-bouncing effect and a more precise dosing of the fluid can be obtained.

What is claimed is:

1. A valve assembly for an injection valve, comprising:

a valve body comprising a central longitudinal axis and a cavity with a fluid inlet portion and a fluid outlet portion, a valve needle axially movable in the cavity, the valve needle preventing a fluid flow through the fluid outlet portion in a closing position and releasing the fluid flow via a main fluid line from the fluid inlet portion to the fluid outlet portion in further positions, a member fixedly coupled to or formed integral with the valve needle and having a surface facing the fluid outlet portion, wherein the surface of the member abuts a first chamber defined in the cavity, wherein a portion of the fluid line defines a second chamber, and a one-way-valve hydraulically arranged between the first chamber and the second chamber and configured to prevent a fluid flow through a first fluid path between the first chamber and the second chamber in a closing position of the one-way-valve and to release a fluid flow through the first fluid path between the first chamber and the second chamber in further positions of the one-way-valve, wherein the one-way-valve comprises a spring and a closing body, wherein the spring is arranged axially between the surface of the member and the closing body and provides a force acting to bring the closing body into contact with an inner surface of the valve body.

2. The valve assembly according to claim 1, wherein a throttle is arranged between the first chamber and the second chamber, and is designed to release a fluid flow through a second fluid path between the first chamber and the second chamber.

3. The valve assembly according to claim 1, wherein the one-way-valve is arranged inside the first chamber to form a part of a boundary of the first chamber.

4. The valve assembly according to claim 1, wherein the closing body comprises a disk shape.

5. The valve assembly according to claim 1, the inner surface of the valve body or an outer surface of the closing body comprising a sealing edge, the sealing edge being designed to prevent the fluid flow through the first fluid path between the first chamber and the second chamber in the closing position of the one-way-valve.

6. The valve assembly according to claim 1, the closing body comprising an opening and the valve needle extending through the opening.

7. The valve assembly according to claim 6, wherein the opening comprises the throttle, and the throttle being designed as a gap between the valve needle and the closing body.

8. The valve assembly according to claim 1, wherein the valve needle is at least partially a hollow needle with an inner recess, the inner recess receiving the main fluid line.

9. An injection valve for a combustion chamber of a combustion engine, the injection valve comprising:

a valve assembly comprising:

a valve body comprising a central longitudinal axis and a cavity with a fluid inlet portion and a fluid outlet portion, a valve needle axially movable in the cavity, the valve needle preventing a fluid flow through the fluid outlet portion in a closing position and releasing the fluid flow via a main fluid line from the fluid inlet portion to the fluid outlet portion in further positions, a member fixedly coupled to or formed integral with the valve needle and having a surface facing the fluid outlet portion, wherein the surface of the member abuts a first chamber defined in the cavity, wherein a portion of the fluid line defines a second chamber, and a one-way-valve hydraulically arranged between the first chamber and the second chamber and configured to prevent a fluid flow through a first fluid path between the first chamber and the second chamber in a closing position of the one-way-valve and to release a fluid flow through the first fluid path between the first chamber and the second chamber in further positions of the one-way-valve, wherein the one-way-valve comprises a spring and a closing body, wherein the spring is arranged axially between the surface of the member and the closing body and provides a force acting to bring the closing body into contact with an inner surface of the valve body.

10. The injection valve according to claim 9, wherein a throttle is arranged between the first chamber and the second chamber, and is designed to release a fluid flow through a second fluid path between the first chamber and the second chamber.

11. The injection valve according to claim 9, wherein the one-way-valve is arranged inside the first chamber to form a part of a boundary of the first chamber.

12. The injection valve according to claim 9, wherein the closing body comprises a disk shape.

13. The injection valve according to claim 9, the inner surface of the valve body or an outer surface of the closing body comprising a sealing edge, the sealing edge being designed to prevent the fluid flow through the first fluid path between the first chamber and the second chamber in the closing position of the one-way-valve.

14. The injection valve according to claim 9, the closing body comprising an opening and the valve needle extending through the opening.

15. The injection valve according to claim 14, wherein the opening comprises the throttle, and the throttle being designed as a gap between the valve needle and the closing body.

16. The injection valve according to claim 9, wherein the valve needle is at least partially a hollow needle with an inner recess, the inner recess receiving the main fluid line.

17. A method of operating a valve assembly for an injection valve, comprising the steps:

providing a valve body comprising a central longitudinal axis and a cavity with a fluid inlet portion and a fluid outlet portion, arranging a valve needle axially movable in the cavity, the valve needle preventing a fluid flow through the fluid outlet portion in a closing position and releasing the fluid flow via a main fluid line from the fluid inlet portion to the fluid outlet portion in further positions, wherein a member coupled to or formed integral with the valve needle has a surface facing the fluid outlet portion, wherein the surface of the member abuts a first chamber defined in the cavity, wherein a portion of the fluid line defines a second chamber, and hydraulically arranging a one-way-valve between the first chamber and the second chamber, wherein the one-way-valve prevents a fluid flow through a first fluid path between the first chamber and the second chamber in a closing position of the one-way-valve and releases a fluid flow through the first fluid path between the first chamber and the second chamber in further positions of the one-way-valve, and wherein the one-way-valve comprises a spring and a closing body, wherein the spring is arranged axially between the surface of the member and the closing body and provides a force acting to bring the closing body into contact with an inner surface of the valve body.

18. The method according to claim 17, further comprising: arranging a throttle between the first chamber and the second chamber, wherein the throttle releases a fluid flow through a second fluid path between the first chamber and the second chamber.

* * * * *